US006971695B2

(12) United States Patent
Backstrom

(10) Patent No.: US 6,971,695 B2
(45) Date of Patent: Dec. 6, 2005

(54) GOLF BALL RETRIEVER

(76) Inventor: Darrell Backstrom, P.O. Box 1881, Greenwood, Nova Scotia (CA) B0P 1N0

( * ) Notice: Subject to any disclaimer, the term of this patent is extended or adjusted under 35 U.S.C. 154(b) by 0 days.

(21) Appl. No.: 10/763,140

(22) Filed: Jan. 22, 2004

(65) Prior Publication Data

US 2005/0164801 A1 Jul. 28, 2005

(51) Int. Cl.[7] ..... A63B 47/02
(52) U.S. Cl. ..... 294/19.2
(58) Field of Search ..... 473/286; 294/19.2

(56) References Cited

U.S. PATENT DOCUMENTS

| | | | | |
|---|---|---|---|---|
| 843,461 | A * | 2/1907 | Husser | 416/72 |
| 1,380,526 | A * | 6/1921 | Carpenter | 294/19.2 |
| 1,516,210 | A * | 11/1924 | Samuels | 416/77 |
| 3,265,430 | A * | 8/1966 | Jenkins | 294/19.2 |
| 3,743,338 | A * | 7/1973 | Seeger | 294/19.2 |
| 5,326,145 | A * | 7/1994 | Lee | 294/19.2 |
| 6,394,640 | B1 * | 5/2002 | Astegno et al. | 366/129 |

* cited by examiner

*Primary Examiner*—Stephen Blau
(74) *Attorney, Agent, or Firm*—Tarolli, Sundheim, Covell & Tummino L.L.P.

(57) ABSTRACT

The present invention relates to a wire golf ball retriever having a substantially circularly light bulb shaped wire formed member with space between adjacent wires to allow the passage of golf balls into the confines thereof so as to retrieve golf balls from relatively inaccessible places including under water in ponds and streams.

13 Claims, 2 Drawing Sheets

GOLF BALL RETRIEVER

FIELD TO WHICH THE INVENTION RELATES

This invention relates to retrieving golf balls from inaccessible locations.

BACKGROUND OF THE INVENTION

This invention relates to a retriever for golf balls, which balls may be located in inaccessible places including under water in ponds and streams.

Golf balls are relatively expensive, so nobody wants to lose them. In addition, in the game of golf, one plays from the nearest location to a hazard, which location depends on the position of the golf ball within the hazard.

For this reason, it is useful to be able to retrieve a particular golf ball from the hazard so as to continue the round of golf play.

Previous systems have been developed in order to accomplish this retrieval. Examples include a spoon-shaped retriever located on the end of a long pole and the manually operated jaw retriever, again mounted on a long pole.

These systems tend to be somewhat difficult to store, handle, and/or maneuver with the end result that the retrieval process is somewhat arduous. This can cause any particular golf party to guesstimate where the particular ball may be and thus proceed without such golf ball.

This guesstimating procedure is sufficiently high that a number of independently minded individuals may earn sufficient money by retrieving golf balls at any given hazard so as to provide spending money.

SUMMARY OF THE INVENTION

This invention relates to a golf ball retriever system, which system includes an expandable retrieval area for passage of a golf ball into the retriever as well as a capture area for holding the ball during the precise retrieval procedure thereafter.

The retrieval area comprises a series of substantially parallel wires which nominally have a distance between the wires slightly less than the diameter of the golf ball being retrieved. This allows the golf ball to pass by these wires by a slight deflection thereof. The capture area completes the golf ball retriever. In this capture area, the distance between adjacent wires is sufficiently less than that of the golf ball that the golf ball cannot escape without major deflection of the retriever.

By incorporating the retriever on the end of a rod totalling the distance between the user and the golf ball, any given golf ball can be retrieved from this hazard in an expeditious and distinctive manner. This allows a particular player to continue play with what is otherwise a lost ball and in addition improves the game of golf by allowing such play to continue without sufficient lost time at determining the preferred location adjacent to where the golf ball became unplayable.

OBJECTS OF THE INVENTION

It is an object of this invention to simplify golf ball retrievers;

It is another object of this invention to facilitate golf ball retrieval;

It is still a further object to provide for a self actuating golf ball retrievers;

It is a further object to protect the integrity of a round of golf;

It is yet another object of this invention to speed up a round of golf;

It is still another object of this invention to allow for small golf ball retrievers;

It is a further object of this invention to simplify the process of golf ball retrieval;

Other objects and a further understanding of the invention may be had by referring to the drawings in which:

DETAILED DESCRIPTION OF THE INVENTION

This invention relates to a retrieval system for circular objects, in the preferred embodiment: golf balls.

According to the U.S. Golf Association, the golf ball must have a diameter of over 1.680", it must be symmetrical, it must be lighter than 1.62 ounces, it has a maximum velocity of 250 feet per second (tolerance of 2%) with an overall distance of 280 yards (straight line tolerance of 6%). This golf ball is to serve as the circular object of the preferred embodiment disclosed.

Figure 1:
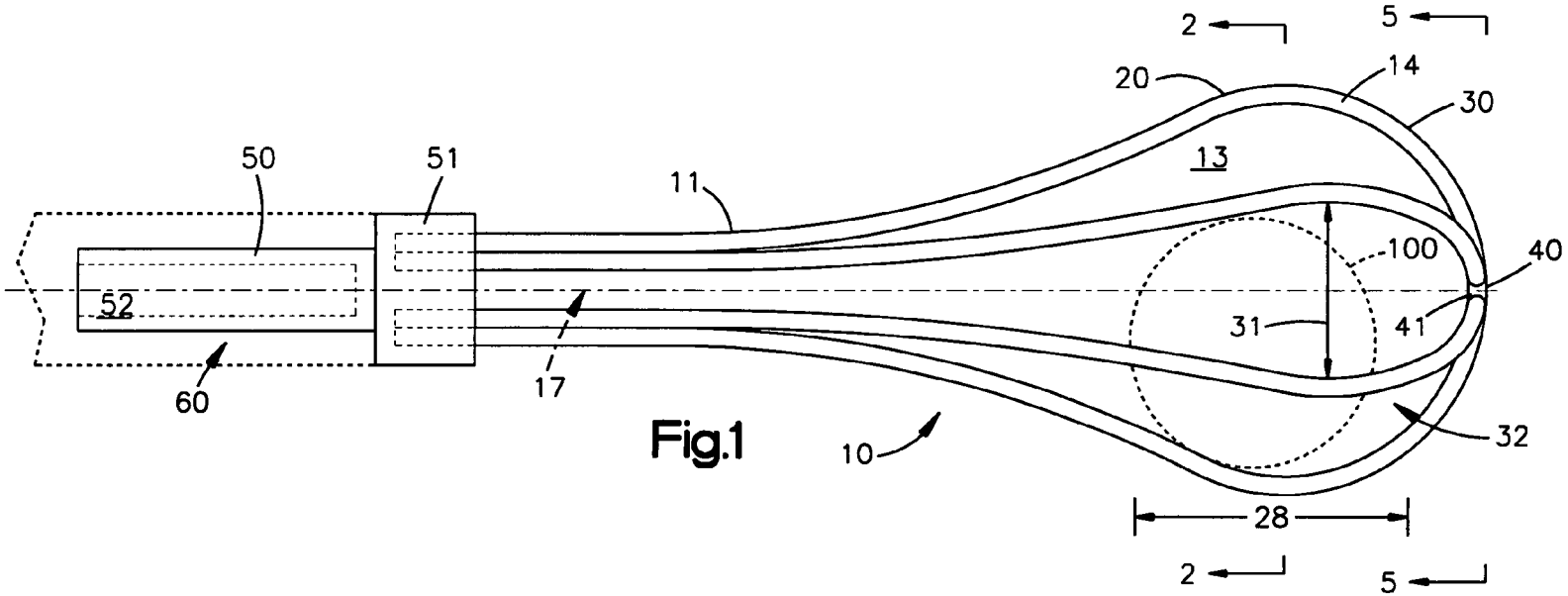
FIG. 1 is a longitudinal side view of a ball retriever incorporating the invention of the application.

The preferred embodiment of the invention in FIG. 1 is a ball retriever 10 having a retrieval area 20, a capture area 30, an end 40, and a fitting 50.

The retriever itself is made out of a series of rods 11 which together form a substantially light bulb shaped member extending between the fitting 50 and the end 40. The number of rods 11 can be varied as long as the distance relationship to the diameter of the golf ball is maintained; four to nine rods is preferred to provide for a small, easy-to-use retriever.

In the particular embodiment disclosed, this includes six substantially equal distant spaced rods 11 forming a member with an overall length of substantially 9" long, each rod being of 0.132" in diameter spaced at substantially 60° angles in respect to the adjacent rod. The retriever itself has a overall diameter of substantially 2.63" having an enlarged portion centered at substantially 1.25" distant from the end 40 and spaced between rods some 1.31". It is made of injected molded plastic: ABS is preferred as the plastic.

Figure 4:
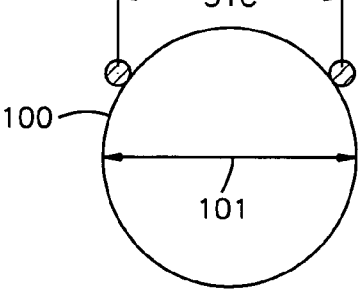
FIGS. 2–4 are cross sectional side views of the ball retriever of FIG. 1 taken substantially along lines 2—2 therein showing the cooperation of adjacent rods of the ball retriever during capture of a golf ball.
Figure 3:
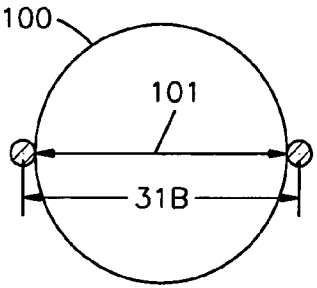
Figure 2:
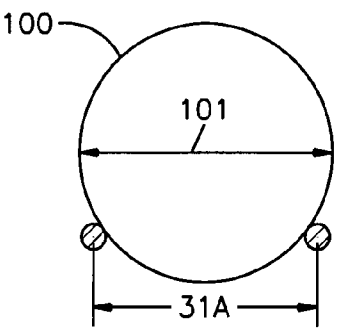
Figure 7:
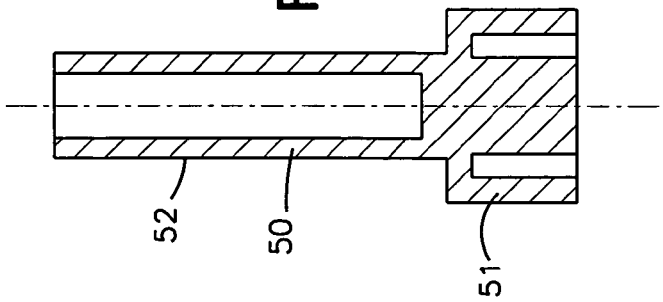
FIGS. 7–8 are cross sectional views of the attachment portion of the retriever of FIG. 1; and, FIG. 9 is a drawing of wires which make up an alternative retriever of FIG. 1.

The rods form a retrieval area 20 at the substantially largest diameter area of the retriever 10. This retrieval area is formed of a series of adjacent rods 21–26. These rods have an original distance 31 therebetween equal to or slightly less than the diameter 101 of the golf ball 100. As shown in FIGS. 2–4, this distance 31 expands to be equal to the diameter 101 of the golf ball 100 during the passage of the golf ball so as to allow the passage of the golf ball into the confines 13 of the retriever 10 (31B in FIG. 3). It is preferred that the unflexed distance 31A between adjoining rods 11 be slightly less than the diameter 101 of the golf ball with a slight flexing of adjacent rods upon the passage of the golf ball 100 into the wire retriever 10. This slightly smaller diameter 31A allows the golf ball to be preliminarily retained in the retriever 10 during any subsequent movement. It is preferred that the distance 31A is 90% to 95% of the diameter of the golf ball 100.

In the preferred embodiment disclosed, the retrieval area 20 has a diameter of substantially 2.63" having the longitudinal extent of the retrieval area centered substantially 1.250" from the end 40 of the retriever.

It is preferred that a retrieval area of the retriever 10 extend for a distance 28 along the outer diameter of the retriever 10. This distance 28 allows for the golf ball to be retrieved by the retriever 10 even though the alignment is not precisely accomplished at the specific largest diameter of the retrieval area 20.

The capture area 30 of the retriever retains the golf ball 100 in the retriever upon the actual removal of the golf ball from the out of play area. To accomplish this, the capture area 30 has a rod spacing 31 less than the diameter 101 of the golf ball. The capture area 30 thus creates a cradle 32 to facilitate the retention of the golf ball in the retriever 10. To accomplish this, the capture area has a diameter 31. The cradle 32 itself is formed at the outer end of the retriever 10. This relationship and that relationship of the retrieval area 20 are set forth in schematic form in FIGS. 1–4. In this relationship, the rod spacing 31 can be flexed to create a spacing greater than the diameter 101 of the golf ball so as to allow the passage of the golf ball into the central area of the retriever 10 while the rod spacing 31 of the capture area 30 is sufficiently small after flexing so as to retain the golf ball during the actual retrieving operation. Note that due to the resiliency of the rods 11 of the retriever, the retrieval 20 and capture area 30 may overlap at their union 14 (i.e., the rods can expand slightly in diameter to allow the passage of the golf ball 100 into the retriever while it may also retain it at the same location due to a slight differentiation between the forces during inward movement between two adjacent rods and the outward movement through the same two adjacent rods). It is preferred, however, that the cradle 32 formed by the capture area 30 be sufficiently long so that it would be difficult for a golf ball to have sufficient force placed thereon that it escapes from the capture area 30 through adjacent rods. It is envisioned that this separation force would occur only upon situations such as the golf ball being located behind a snag which would artificially increase the tension on the golf ball so as to allow its escape from the capture area 30 during retrieval. In the preferred embodiment disclosed, the capture area extends 75% to 95% of the length from the retrieval area 20 to the outer end 40 of the retriever 10.

In the preferred embodiment disclosed, the capture area 30 extends from substantially 1.25" from the end 40 to the end of the central area 41 of the retriever 10. It is preferred that this distance be substantially greater than ½ of the diameter of the golf ball so that once the golf ball is captured in the cradle 32, it would not have sufficient force to escape from the cradle 32 during normal usage.

The end 40 cooperates with the capture area 30 to form the outer cradle 32 for the retriever 10. It is preferred that the outer end 40 include a cap 41 integrally joining all of the rods 11. This fitting would prevent the radial displacement of the central axis 17 of the retriever 10, thus to ensure consistent operation of the retriever no matter which two adjacent rods 21–26 may be utilized in a particular retrieval operation. This ensures a uniformity of operation in the device during the retrieval. It also ensures consistent operation of the cradle 32 by not allowing the major physical displacement of any of the rods 21–26 forming such cradle.

In the preferred embodiment disclosed, the end cap 41 is a member substantially 0.40" in diameter integrally joining all of the rods 21–26 at their outwardly extending end.

The fitting 50 of the retriever 10 completes its construction.

The fitting 50 is designed to interconnect the retriever 10 onto the pole 60 utilized with the retriever 10. Preferably, this fitting 50 is separable from the pole 60 so as to allow the usage of the pole with alternate devices. It is further preferred that this pole 60 be an expanding pole so as to allow its inclusion into a normal golf bag while also allowing a sufficient distance for satisfactory retrieval of the golf ball from the out of bounds area.

In the preferred embodiment disclosed, the fitting 50 includes two sections 51, 52. Section 51 of the fitting 50 is designed to retain the ends of the rods 21–26 onto the fitting 50, thus to orient the rods in their proper shape. In the preferred embodiment disclosed, this section 51 has six holes substantially 0.5" deep located on a 0.54" between the center axis of adjacent rods 21–26. The rods 21–26 themselves are glued or applied fixedly attached to this section 51.

This section 52 is designed to cooperate with the pole 60 so as to interconnect the retriever 10 to such pole.

In the preferred embodiment disclosed, this section 52 is a reduced diameter section integrally glued or otherwise fixedly connected to the pole 60.

Figure 8:
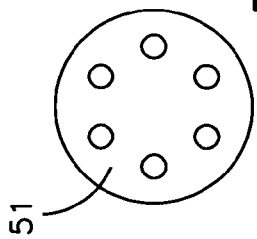
Figure 6:
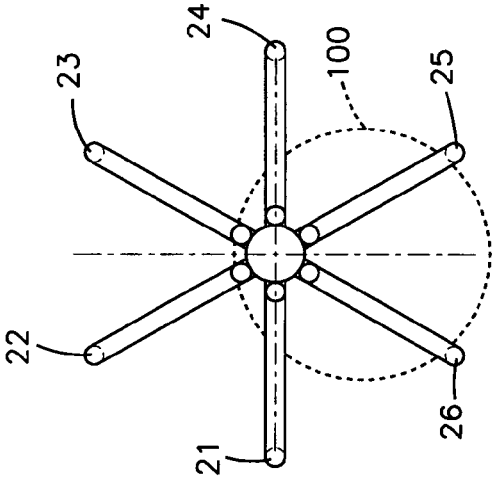
FIGS. 5–6 are end views of the ball retriever of FIG. 1 taken substantially along the lines 5—5 therein.
Figure 5:
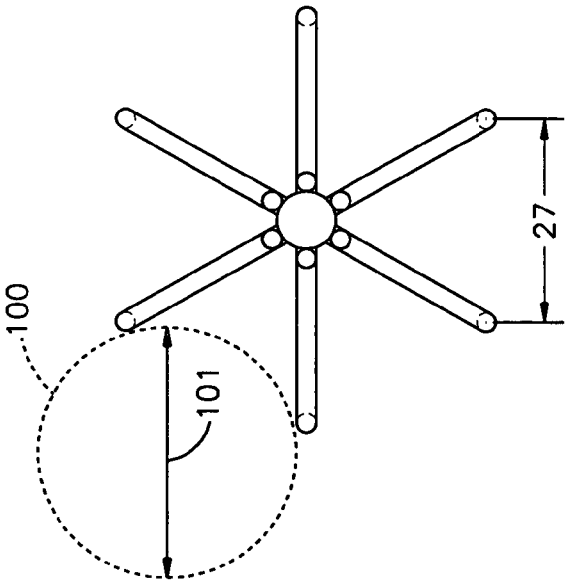
Figure 9:
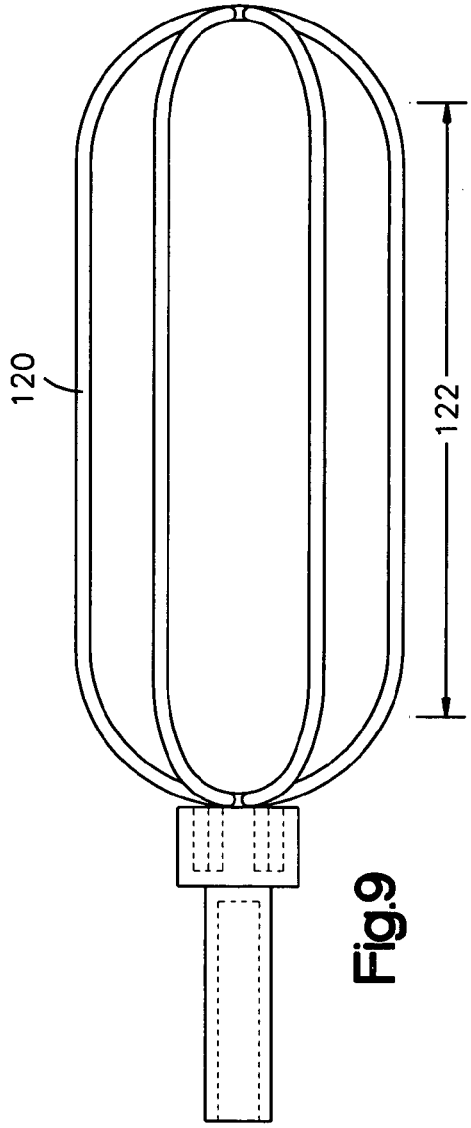

Although the preferred embodiment of the invention has been disclosed in its preferred form with a certain degree of particularity, it is to be understood that changes can be made without deviating from the invention as hereinafter claimed. For example, with alternative sizing, the retriever could be utilized to retrieve tennis balls. An example of this is shown in FIG. 8 wherein the retrieval section 120 extends for a greater length 122 than in FIG. 1.

What is claimed is:

1. A ball retriever for a golf ball having a diameter, the retriever comprising a handle, said handle being attached to a pole, at least three consecutively spaced wires extending from said handle, said wires having outer ends respectively, the space between adjacent pairs of said three consecutively spaced wires having an unexpanded distance less than the diameter of the golf ball, a cap, said cap integrally joining said outer ends of said wires so as to form a cradle for the retriever, and said adjacent pairs of wires being flexible so as to allow the expansion of said distance therebetween to be at least equal to the diameter of the golf ball so as to allow the golf ball to pass therethrough into the cradle.

2. The retriever of claim 1 characterized in that said retriever has six consecutive wires extending 360° in respect to the axis of the handle.

3. The retriever of claim 2 characterized in that said six wires are equally spaced about the axis of the handle.

4. The retriever of claim 1 characterized in that said distance extends along the longitudinal axis of the retriever to form a capture zone.

5. The retriever of claim 4 characterized in that said distance is reduced in respect to the axis of said handle inwards and outwards of said capture zone.

6. The retriever of claim 1 characterized in that said handle and said wires are separable from each other.

7. The retriever of claim 1 characterized in that said handle is the shaft of a golf club.

8. The retriever of claim 1 characterized in that the golf ball has a diameter and said distance between said adjacent pairs of wires is from 80% to 95% of the diameter of the golf ball in their unexpanded cradle position.

9. The retriever of claim 8 characterized in that there are six wires equally spaced 360° about the axis of said handle.

10. The retriever of claim 9 characterized in that said wires join outside of said cradle.

11. The retriever of claim 10 characterized in that said wires join inside of said cradle.

12. A ball retriever for a golf ball having a diameter, the retriever comprising a handle, said handle being attached to a pole, at least six consecutively spaced wires, each of said six wires having an inner and an outer end extending radially outwardly from said handle, a cap, said cap integrally joining said outer ends of said six consecutively spaced wires, the space between any adjacent pair of said six consecutively spaced wires having an unexpanded distance less than the diameter of the golf ball, and said adjacent pairs of wires being flexible so as to allow the expansion of said distance therebetween to be at least equal to the diameter of the golf ball so as to allow the golf ball to pass therethrough into the cradle.

13. A ball retriever for a golf ball having a diameter, the retriever comprising a handle, said handle being attached to a pole, said handle having a central axis, said central axis defining the central axis of the retriever, at least six consecutively spaced wires, said consecutively spaced wires being connected to said handle substantially equally circumferentially spaced 360° about the center axis of the retriever, each of said six wires having outer ends respectively extending longitudinally displaced from said handle and substantially aligned with said central axis of the retriever, a cap, said cap integrally joining said outer ends of said six consecutively spaced wires at said outer ends of said wires to prevent the radial displacement of said outer ends of said wires from said central axis of the retriever so as to form a cradle of said wires, the space between any adjacent pair of said six consecutively spaced wires having an unexpanded distance less than the diameter of the golf ball, and said adjacent pairs of wires being flexible so as to allow the expansion of said distance therebetween to be at least equal to the diameter of the golf ball so as to allow the golf ball to pass therethrough into the cradle.

* * * * *